US006347700B1

(12) United States Patent
Redfield et al.

(10) Patent No.: US 6,347,700 B1
(45) Date of Patent: Feb. 19, 2002

(54) COMPOSITE PACKAGE FOR EXPLOSIVE ITEMS

(75) Inventors: Robert J. Redfield, Granbury; William D. Jackson, Fort Worth; Stanley D. Pastusek, Arlington, all of TX (US)

(73) Assignee: The Ensign-Bickford Company

( * ) Notice: Subject to any disclaimer, the term of this patent is extended or adjusted under 35 U.S.C. 154(b) by 0 days.

(21) Appl. No.: 09/564,908

(22) Filed: May 4, 2000

Related U.S. Application Data

(60) Provisional application No. 60/132,629, filed on May 5, 1999.

(51) Int. Cl.[7] ..... F42B 39/00
(52) U.S. Cl. ..... 206/3; 206/521; 217/53
(58) Field of Search ..... 206/3, 521, 524.6, 206/216; 217/36, 53, 5, 17

(56) References Cited

U.S. PATENT DOCUMENTS

| | | | | |
|---|---|---|---|---|
| 1,328,524 A | | 1/1920 | Knapp | |
| 1,631,756 A | | 6/1927 | Olin | |
| 1,716,628 A | | 6/1929 | Gittleman | |
| 2,352,998 A | | 7/1944 | Alexander et al. | |
| 2,393,221 A | | 1/1946 | Mercer et al. | |
| 2,601,919 A | | 7/1952 | Darbyshire | |
| 2,660,300 A | | 11/1953 | Pauls | |
| 2,669,351 A | | 2/1954 | Carson et al. | |
| 2,868,360 A | | 1/1959 | Donkin | |
| 2,954,140 A | | 9/1960 | Sutherland et al. | |
| 3,456,783 A | | 7/1969 | Clark | |
| 3,590,739 A | | 7/1971 | Persson | |
| 3,981,240 A | | 9/1976 | Gladden | |
| 4,263,365 A | * | 4/1981 | Burgess et al. | 428/310 |
| 4,266,670 A | * | 5/1981 | Mykleby | 206/600 |
| 4,324,333 A | | 4/1982 | Porter | |
| 4,586,602 A | | 5/1986 | Levey | |
| 4,817,787 A | | 4/1989 | Owen | |
| 4,895,249 A | | 1/1990 | Davis et al. | |
| RE33,446 E | | 11/1990 | Levey, Sr. | |
| 5,005,694 A | | 4/1991 | Davis et al. | |
| 5,007,230 A | | 4/1991 | Gaston | |
| 5,127,593 A | | 7/1992 | Gaston | |
| 5,129,514 A | | 7/1992 | Lilley, Jr. | |
| 5,160,023 A | | 11/1992 | Adams et al. | |
| 5,494,152 A | | 2/1996 | Sobczak et al. | |
| 5,924,887 A | * | 7/1999 | Landman | 217/36 |

FOREIGN PATENT DOCUMENTS

| | | |
|---|---|---|
| WO | WO 92/21571 | 12/1992 |

* cited by examiner

*Primary Examiner*—David T. Fidei
*Assistant Examiner*—Shian Luong
(74) *Attorney, Agent, or Firm*—Libert & Associates; Victor E. Libert; Frederick A. Spaeth

(57) ABSTRACT

The present invention pertains to a composite package system that provides sufficient protection and containment of eight explosive devices that contain 33 grams each (264 grams total) of RDX explosive or the equivalent thereof, such as HMX, HNS, etc., to qualify for a U.S. Department of Transportation (DOT) classification of 1.4S. The composite package system of this invention comprises the combination of a prior art corrugated paper box in a wooden crate that meets DOT 4C1 requirements and that is lined with cement-fiber material.

16 Claims, 2 Drawing Sheets

COMPOSITE PACKAGE FOR EXPLOSIVE ITEMS

CROSS-REFERENCE TO RELATED APPLICATION

This application claims the benefit of U.S. Provisional application Ser. No. 60/132,629, filed May 5, 1999.

BACKGROUND OF THE INVENTION

FIELD OF THE INVENTION

This invention relates to packaging materials and, more particularly, to a composite package for shipping and storing explosive items.

The need to transport commercial quantities of devices containing explosive material gives rise to concerns regarding the safety with which packages containing such devices can be moved and stored. It is important to provide proper packaging of such devices because the packages (and their contents) may be exposed to a wide range of temperatures and may be subjected to a variety of physical stresses, e.g., impacts that occur should the package be dropped or jostled. In designing a packaging system for such items, attention must be given not only to preventing unwanted initiation of the items in the package, but also to the prevention of the propagation of inadvertent initiation of items in one package to those in another.

The degree to which these objectives are met by a packaging system has practical, legal and commercial significance.

SUMMARY OF THE INVENTION

The present invention pertains to a composite package system that provides sufficient protection and containment of eight explosive devices that contain 33 grams each (264 grams total) of RDX explosive or the equivalent thereof, such as HMX, HNS, etc., to qualify for a U.S. Department of Transportation (DOT) classification of 1.4S. The composite package system of this invention comprises the combination of a prior art corrugated paper box in a wooden crate that meets DOT 4C1 requirements and that is lined with cement-fiber material.

Accordingly, the present invention provides a container for explosive materials comprised of cardboard, wood and a cement-fiber material.

According to one aspect of the invention, the cement-fiber material may comprise portland cement and cellulose fiber, optionally in an amount of about 5 to 10 percent cellulose fiber. In one embodiment, the container may have sufficient strength to contain the detonation therein of a plurality of explosive devices comprising a total of 320 grams of explosive material.

In a particular embodiment, the wood may comprise a wooden crate which measures about 36.8 centimeters×36.8 centimeters×30.5 centimeters (14.5 inches×14.5 inches×12 inches) and which comprises pine board having a thickness of about 1.9 centimeters (¾ inch); and may be cement-fiber material at the bottom of the container having a thickness of about 10 centimeters (4 inches), cement-fiber material at the sides of the container having a thickness of about 2.5 centimeters (1 inch), and cement-fiber material at the top of the container having a thickness of from about 3.1 centimeters (1¼ inches) to 4 centimeters (1 9/16 inches); and there may further be at the bottom of the container three layers of cardboard having a bursting strength of about 200 pounds per square inch ("200 psi cardboard") and a layer of 250 psi cardboard, and at each side of the container three layers of 275 psi cardboard and a layer of 250 psi cardboard, and comprising at the top of the container two layers of 275 psi cardboard and a layer of 250 psi cardboard. Optionally, the 250 psi cardboard may comprise a cardboard box in the crate.

In a specific embodiment of the invention, there may be a plurality of cement-fiber material at the bottom of the container, at each side of the container, and at the top of the container. Optionally, the 250 psi cardboard may comprise a cardboard box in the crate.

This invention also relates to a package comprising a plurality of explosive devices enclosed in a container as described herein. Optionally, the devices may comprise a total of not more than about 320 grams of explosive material. There may be, for example, from about 264 to 320 grams of explosive material.

According to another aspect of the invention, the package may contain eight devices and each device may be disposed in a positioning tube. Four of the positioning tubes may be disposed in a first array in the container and four of the positioning tubes may be disposed in a second array above the first array. Preferably, the devices in the second array are not vertically directly above devices in the first array.

The present invention also relates to a method for packaging a plurality of explosive devices, the method comprising enclosing the devices in a container as described herein.

DETAILED DESCRIPTION OF THE INVENTION AND PREFERRED EMBODIMENTS THEREOF

The present invention pertains to a composite package system that provides sufficient protection and containment of eight items that contain 33 grams each (264 grams total) of RDX explosive or the equivalent thereof, such as HMX, HNS, etc., to qualify for a U.S. Department of Transportation (DOT) classification of 1.4S. The 1.4S classification indicates that the package and contents therein present a moderate fire/no blast hazard. Prior art packaging systems for such devices carry DOT classifications of 1.1D, indicating risk of mass detonation hazard. The composite package of the present invention may maintain a 1.4S rating even with items that contain more than 33 grams of explosive each, e.g., 40 grams each.

The composite package of the present invention comprises a wooden crate, a cementfiber lining and a prior art cardboard box package within which the explosive items are packed.

A suitable wooden crate may have a DOT rating of 15A100 and may meet the 4C1 classification as set forth in Title 49 of the Code of Federal Regulations, Sec. 172.63, as a "natural wood ordinary box".

The cement-fiber lining may comprise sheets of material comprising portland cement into which about five to ten percent cellulose fiber has been incorporated. Sheets of such material are commercially available and are sold for use as exterior siding material for residential homes. The lining material reinforces all six panels (top, bottom and four sides) of the wooden crate, to varying thicknesses. One such material is sold under the trade designation Hardiplank® and is described as comprising portland cement, ground sand, cellulose fiber, select additives and water, and as being free of asbestos, fiberglass and formaldehyde.

The cardboard box packaging that is disposed within the wooden crate and cement-fiber lining may have sufficient strength to earn a DOT classification of 1.1D with the explosive items therein.

Figure 1:
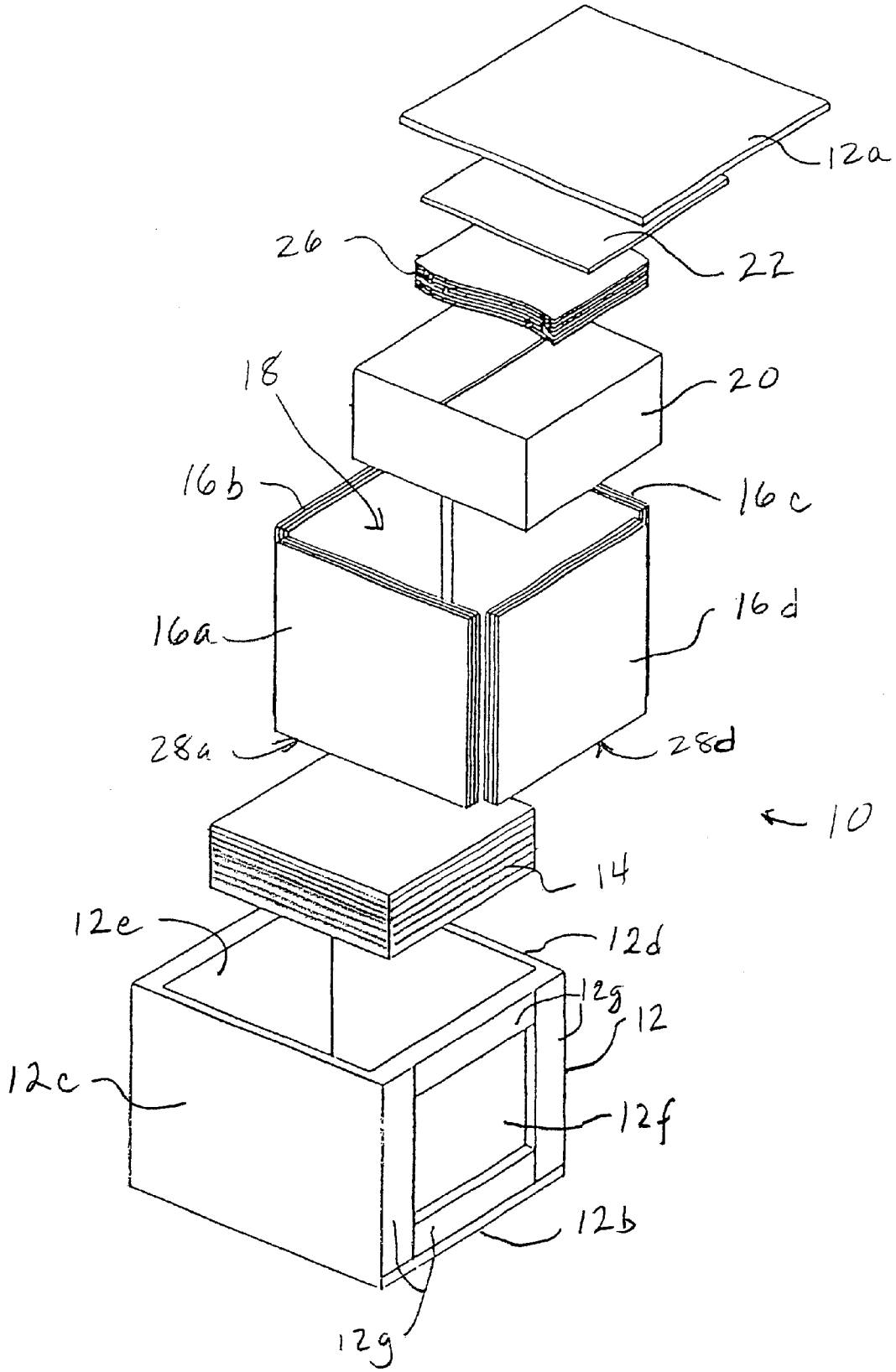
FIG. 1 is an exploded axonometric view of a composite package according to a particular embodiment of the present invention.

In one particular embodiment of the invention, shown in FIG. 1, composite package 10 comprises a wooden crate 12 whose interior measures 14.5×14.5×12 inches. The top 12*a* and bottom 12*b* of the crate are each made from ¾ inch thick pine board and measure 17¾×16½ inches. Two sides 12*c*, 12*d* are made from ¾ inch thick pine board and measure 17¾×12 inches, the other two sides (the "ends") 12*e*, 12*f* are made from ¾ inch thick pine board and measure 14¾×12 inches. Both ends are reinforced about their perimeters with pine strips 2¼ inches wide. FIG. 1 shows reinforcing strips 12*g* on end 12*f*. The crate is held together with 1¼ inch screw shank nails and corrugated fasteners. The crate meets the criteria for a DOT 4C1/428/5199 classification described above and ratings of UN90 and USA/+AQ/0335.

A bottom lining 14 comprising thirteen sheets of 5/16 inch thick cement-fiber material measuring 12×12½ inches is placed on the bottom of the crate with the 12 and 12½ inch lengths alternating in orientation. Side linings 16*a*, 16*b*, 16*c*, 16*d* each comprising three sheets of 5/16 inch cement-fiber material are positioned at each side of the crate, cooperating with the bottom lining 14 to define an open central area 18 inside the crate. The side linings 16*a*, 16*b*, etc., fit around the bottom lining 14 so that the bottom edges (only two of which, 28*a* and 28*d*, are shown) of the side linings 16*a*, 16*b*, etc., rest on the bottom of the wooden crate. The open central area 18 is sized to receive a prior art cardboard box package 20 that contains the explosive devices. A top lining 22 comprising five sheets of 5/16 inch cement-fiber material oriented as in the bottom lining are placed on top of the cardboard box, and the wooden crate is closed with a wooden lid 24. Optionally, product literature 26 may be placed in the crate before it is closed. The tare weight of the outer packaging of the assembled composite package is about 96 pounds.

If the top lining 22 stands too high to allow for proper sealing of the wood crate, then sheets of cement-fiber material measuring ¼ inch thickness may substitute for the 5/16 inch thick sheets in the top lining 22 until the proper height is achieved. The top 12*a* is then screwed onto the wooden crate.

As indicated above, the prior art cardboard box package 20 positioned within the open central space of the composite package system of the present invention may hold a plurality of devices that contain charges of explosive materials. The composite package system of the present invention will perform satisfactorily to retain the 1.4S DOT rating with a total of the equivalent of 264 grams of explosive material therein such as RDX (cyclo-1,3,5-trimethylene-2,4,6-trinitramine), HMX (cyclotetramethylene tetranitramine), HNS (hexanitrostilbene), etc. The composite package system 10 has demonstrated the ability to maintain its structural integrity upon the initiation of such an amount of explosive material therein and, because it is lined with cement, it is effectively flame resistant to combustion initiated from within.

Figure 2:
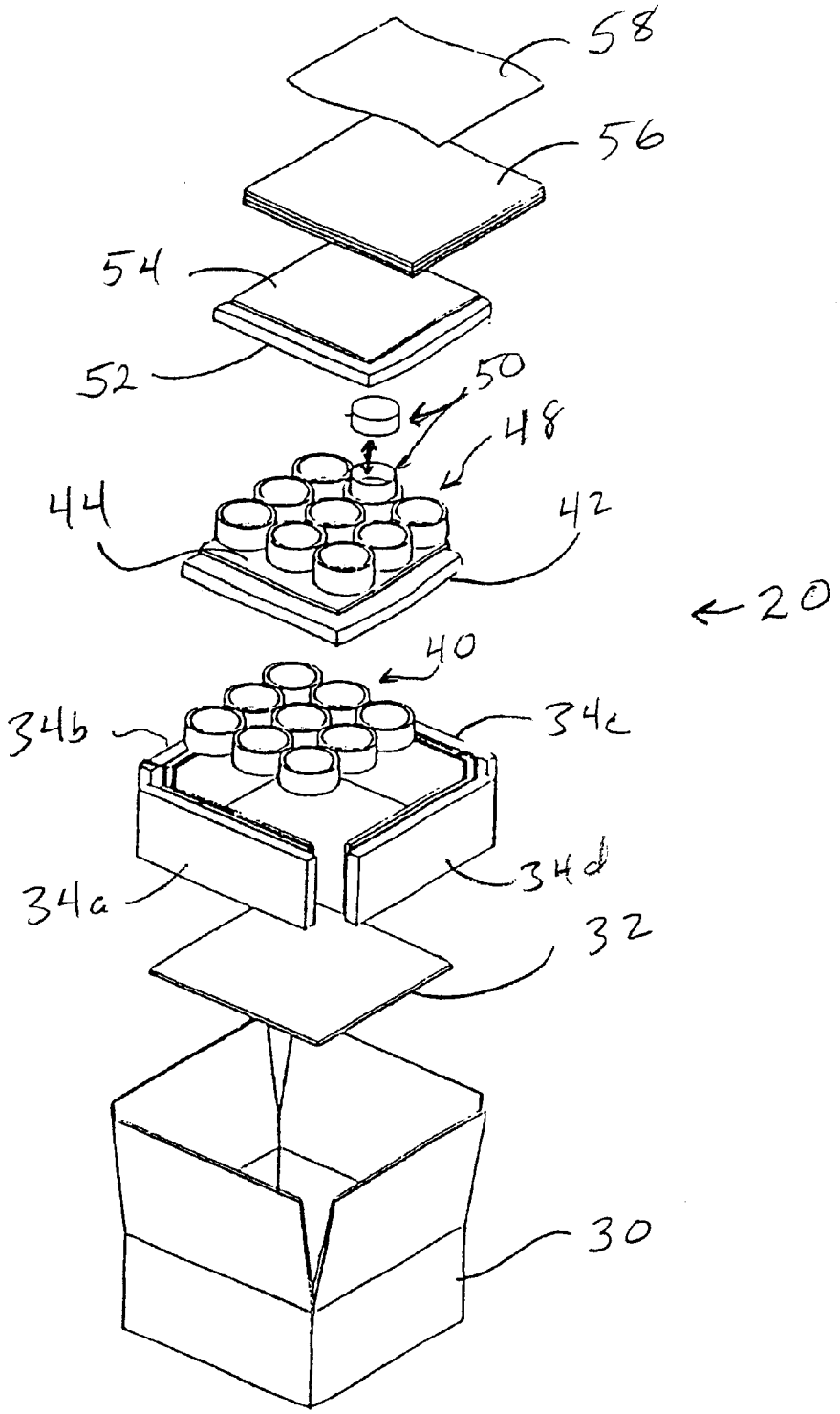
FIG.2 PRIOR ART
FIG. 2 is an exploded axonometric view of a particular prior art package that may be incorporated into the composite package of FIG. 1.

The conventional cardboard package 20 disposed within the composite package 10 of the present invention may contain a plurality of items, each of which may contain a portion of the total quantity of explosive material in the container. As indicated above, the prior art package 20 is not relied upon for its resistance to flame or to the detonation of the explosive material therein, and may have a DOT rating of merely 1.1D. One such conventional package 20 is illustrated in FIG. 2 for the containment of eight explosive cartridges used in tube cutting devices. The particular type of unit, however, is not a limitation on this invention, which pertains equally to detonators, shaped charges, and any other items that contain charges of explosive materials. Each cartridge in the illustrated embodiment contains 33 grams of HMX or HNS. The package provides two layers of cylindrical cardboard rings within which the cartridges are positioned. Each layer comprises an array of nine positioning rings carried on a cardboard tray. The cartridges are disposed in positioning rings in the two layers so that no cartridge is positioned vertically directly above another cartridge. Thus, the possible propagation of initiation from one inadvertently initiated cartridge to another is reduced relative to a configuration in which cartridges are positioned one directly above the other within the package.

The package 20 shown in FIG. 2 comprises a cardboard closure box 30 comprising double-wall corrugated fiberboard Kraft paper, 275 psi (pounds per square inch) burst strength. A bottom pad 32 is positioned in the bottom of the closure box. The bottom pad comprises a sheet of double-wall corrugated fiberboard Kraft paper, 200 psi burst strength that is cut-scored, reverse cut-scored and folded in a Z-configuration into a triple-thickness pad. Four side pads 34*a*, 34*b*, 34*c*, 34*d* are set upon the bottom pad 32 and are disposed against respective sides of the closure box 30. The side pads 34*a*, 34*b*, etc., are made of double-wall corrugated 275 psi bursting strength corrugated paperboard that has been cut-scored and reverse cut-scored for a Z-fold or triple-thickness fan-fold configuration. In addition, two single-layer, double-wall corrugated 275 psi paperboard pads are layered against each side pad. The bottom pad 32 serves as a tray on which a first 3×3 array of cardboard or paper positioning tubes 40 is placed. The positioning tubes 40 are made from high-density Kraft paper with a thickness of approximately ¼ inch. Four explosive cartridges, each enclosed in a two-part plastic packing container 50 sized for a snug fit in a positioning tube, are placed in tubes in the first array and a cushion pad 42 is placed over the first array and a 9×9 inch divider pad 44 is placed on top of the cushion pad 42. The cushion pad is provided for compressive resiliency. A suitable cushion pad may comprise layered tissue paper. One commercially available cushion pad is sold under the trade name Kimpak™. The divider pad 44 comprises a single layer of double-wall corrugated fiberboard Kraft paper, 200 psi burst strength and serves as a tray for a second array of positioning tubes 48 into which four more cartridges are disposed. A second cushion pad 52 is placed over the second array and a second single-layer divider pad 54 is placed over the second cushion pad. A top pad 56 like the bottom pad 32 is placed over the second divider to complete the contents of the box. Optionally, product literature 58 may be included in the package. The closure box 30 is sealed and is ready for incorporation into the composite package 10 (FIG. 1) of the present invention.

What is claimed is:

1. A container having a top and a bottom comprised of cardboard, wood and a cementfiber material, wherein the wood comprises a wooden crate which measures about 36.8 centimeters×36.8 centimeters×30.5 centimeters (14.5 inches×14.5 inches×12 inches) and which comprises pine board having a thickness of about 1.9 centimeters (¾ inch); and comprising cement-fiber material at the bottom of the container having a thickness of about 10 centimeters (4 inches), cement-fiber material at the sides of the container having a thickness of about 2.5 centimeters (1 inch), and cement-fiber material at the top of the container having a thickness of from about 3.1 centimeters (1¼ inches) to 4 centimeters (1 9/16 inches); and comprising at the bottom of the container three layers of cardboard having a bursting strength of about 200 pounds per square inch ("200 psi cardboard") and a layer of 250 psi cardboard, and comprising at each side of the container three layers of 275 psi cardboard and a layer of 250 psi cardboard, and comprising at the top of the container two layers of 275 psi cardboard and a layer of 250 psi cardboard.

2. The container of claim 1 comprising a cardboard box comprising said layer of 250 psi cardboard at the bottom of the container, at each side of the container, and at the top of the container.

3. The container of claim 1 comprising a plurality of sheets of said cement-fiber material at the bottom of the container, at each side of the container, and at the top of the container.

4. The container of claim 3 comprising a cardboard box comprising said layer of 250 psi cardboard at the bottom of the container, at each side of the container, and at the top of the container.

5. A method for packaging a plurality of explosive devices, the method comprising enclosing the devices in a container as described in claim 1.

6. The method of claim 5 wherein the plurality of explosive devices comprises a total of not more than about 320 grams of explosive material.

7. The method of claim 6 wherein the plurality of explosive devices comprises a total of from about 264 to 320 grams of explosive material.

8. The method of claim 5 comprising a cardboard box comprising said layer of 250 psi cardboard at the bottom of the container, at each side of the container, and at the top of the container.

9. The method of claim 5 wherein there are eight devices, the method comprising placing each device in a positioning tube and placing four of the tubes in a first array and placing four of the tubes in a second array above the first array.

10. The method of claim 9 wherein the devices in the second array are not disposed vertically directly above devices in the first array.

11. A package comprising a container having a top and a bottom comprising a wooden crate which measures about 36.8 centimeters× 36.8 centimeters×30.5 centimeters (14.5 inches×14.5 inches×12 inches) and which comprises pine board having a thickness of about 1.9 centimeters (¾ inch);

cement-fiber material at the bottom of the crate having a thickness of about 10 centimeters (4 inches), cement-fiber material at each side of the crate having a thickness of about 2.5 centimeters (1 inch), and cement-fiber material at the top of the crate having a thickness of from about 3.1 centimeters (1¼ inches) to 4 centimeters (1 9/16 inches);

a cardboard box in the crate comprising cardboard having a bursting strength of about 250 pounds per square inch ("250 psi cardboard"); three layers of 200 psi cardboard at the bottom of the box, three layers of 275 psi cardboard at each side of the box, and two layers of 275 psi cardboard at the top of the box; and a plurality of explosive devices in the container.

12. The package of claim 11 comprising a plurality of sheets of said cement-fiber material at the bottom of the crate, at each side of the crate, and at the top of the crate.

13. The package of claim 12 wherein the devices comprise a total of not more than about 320 grams of explosive material.

14. The package of claim 13 wherein the devices comprise a total of from about 264 to 320 grams of explosive material.

15. The package of claim 11 comprising eight devices and wherein each device is disposed in a positioning tube, and wherein four positioning tubes are disposed in a first array and four positioning tubes are disposed in a second array above the first array.

16. The package of claim 15 wherein the devices in the second array are not vertically directly above devices in the first array.

* * * * *